United States Patent [19]

Siev et al.

[11] Patent Number: 4,808,973

[45] Date of Patent: Feb. 28, 1989

[54] WINDOW TAPE ALARM INTERLOCK DEVICE

[76] Inventors: Avinadav Siev, 179-20 Croydon Rd., Jamaica Estates, N.Y. 11432-2206; Morel Groper, 72 Eli Cohen Street, Naharia, Israel; Ahron Siev, 97A Einstein Street; Rami Siev, 22 Burla Street, both of Haifa, Israel

[21] Appl. No.: 104,264

[22] Filed: Oct. 2, 1987

[51] Int. Cl.[4] ..... G08B 13/08; G08B 13/04

[52] U.S. Cl. ..... 340/545; 340/531; 340/550; 340/686

[58] Field of Search ..... 340/545, 550, 531, 540, 340/686

[56] References Cited

U.S. PATENT DOCUMENTS

| | | | |
|---|---|---|---|
| 3,636,484 | 1/1972 | Lea | 340/545 |
| 4,057,783 | 11/1977 | Blanchier | 340/531 |
| 4,227,766 | 10/1980 | Finale | 340/545 |
| 4,271,338 | 6/1981 | Rakocy | 340/547 |

*Primary Examiner*—Glen R. Swann, III
*Attorney, Agent, or Firm*—Richard L. Miller

[57] ABSTRACT

A contactless window tape alarm interlock device is provided that eliminates the need to manually connect or separate an alarm system and tape strips mounted on panes of glass contained in operable window frames. This prevents breakage of the connections when the window frame positions are shifted for servicing or cleaning. An assembly containing an oscillator, detector and magnetic coupling coils is mounted to each fixed window casement. An electrical tape strip is bonded to each window pane and is connected with a pair of coils contained in an assembly mounted to each moveable window frame. The coil assemblies are located in magnetic proximity to one another. The signal from the oscillator is coupled to the detector via the coils and window tape. Any change in the coupling between coils or a break in any of the strips causes a detector to set off the alarm.

3 Claims, 1 Drawing Sheet

WINDOW TAPE ALARM INTERLOCK DEVICE

BACKGROUND OF THE INVENTION

The instant invention is related, generally to the field of alarm devices, and more specifically to alarms used to protect operable openings, such as windows, or doors from unauthorized entry and breakage. However, other usages are possible as will be mentioned later.

Numerous alarm interlock devices have been provided in the prior art that are adapted to cooperate with foil tape. For example, U.S. Pat. Nos. 3,636,484 to Lea; 4,227,766 to Finale; and 4,271,338 to Rakocy all are illustrative of such prior art. While these units may be suitable for the particular purpose to which they address, they would not be as suitable for the purpose of the present invention as hereafter described.

At the present state of the art openings are often protected against breakage by bonding electrically conductive strips of metal tape to their surface. The strips end at an electrical terminal. When the opening is not operable, such as at store front window, the terminal is hard wired into the alarm system. When an opening is operable, a hard wire is not adequate. For simplicity we will call an operable opening "window", and it may mean window, door, shutter etc.

If it moves around a hinge, a flexible wire connection may be put near the hinge. This arrangement will not protect against breakage of the lock for which an additional protection, such as a magnetic reed, must be introduced.

For sliding windows, or double hung windows, the interlock of the window may be achieved by one of the following two devices:

(a) A springy double contact which closes the electrical circuit when the window is brought to the desired position. Use of such devices has resulted in many false alarms, and therefor the industry has in many cases switched to the second device.

(b) A plug and a socket which have to be connected or disconnected manually. The big disadvantage of this solution is that the user may occasionally forget to disconnect and thus damage the system. Even when the plug socket combination is used correctly, the repetitive movement causes one of the connections to loosen up.

At the current state of the art windows are also protected against forced opening by using a magnetic reed switch which activates when the window is forced to a position other than its normally closed one. While there is no danger of breakage to the alarm's electrical connections, this configuration does not protect against glass or other panel material breakage.

SUMMARY OF THE INVENTION

It is, therefore, a primary object of the present invention to provide a window tape alarm interlock device which sets off an alarm when any window glass is broken.

A further object is to provide a window tape alarm interlock device which sets off an alarm when any window is forced from its desired position.

A still further object is to provide a contactless window tape alarm interlock device which uses electromagnetic coupling between a set of coils mounted to both the window frame and to the corresponding window casement. This eliminates the need for manually connecting or separating a plug and socket when the window positions are charged for maintenance, cleaning, etcetera.

A yet further object is to provide a window tape alarm interlock device which is simple and inexpensive to fabricate and has high reliability in operation.

A yet still further industrial application of the instant invention is to activate an electrical current, or a certain operation, in a moving article on a conveyor belt when the article reaches a desired position.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
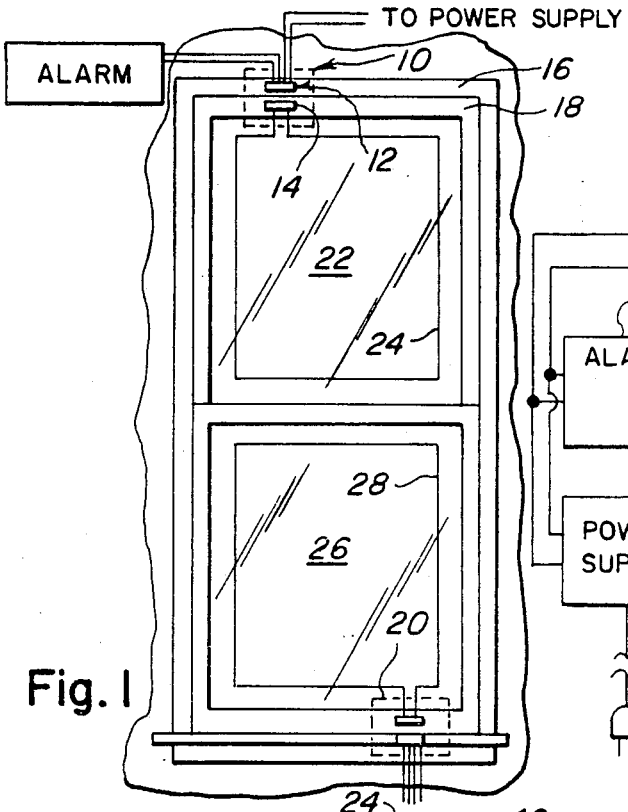
FIG. 1 is an elevational view of a typical window with the invention installed thereon.

In FIG. 1, each interlock device 10 contains a primary housing 12 and a secondary housing 14. Each primary housing 12 is fixed to a window casement 16 and each secondary housing 14 is fixed to a window frame 18, such that when the window is in its desired position housings 12 and 14 are in close proximity. Interlock device 10 protects the top window while interlock device 20 protects the bottom window. While interlocks 10 and 20 are illustrated on top and bottom of windows, it is to be understood they can also be placed on the sides of windows as desired. Top window pane 22 is further protected by an electrically conductive strip 24, which is bonded to it. Bottom window pane 26 is likewise protected by electrical strip 28. In case of screens 24 will represent an interwoven breakable conductive wire.

Figure 2:
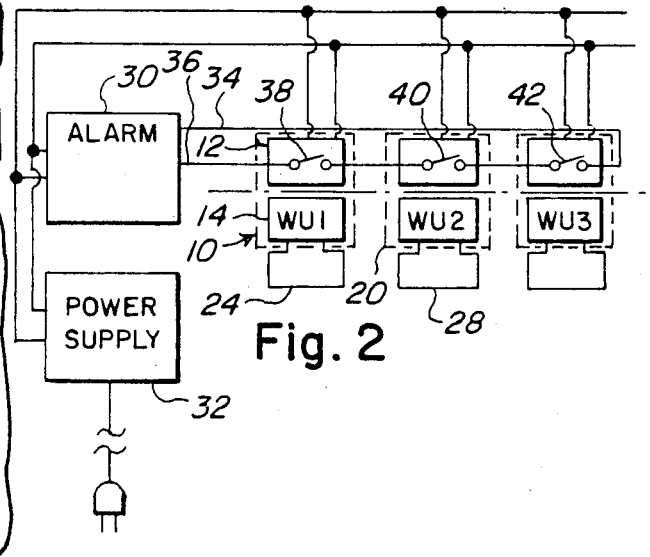
FIG. 2 is a typical block diagram showing a plurality of interlock devices hooked up in series with normally closed switching logic.

The use of the interlock devices in a multi-window alarm system is best understood with reference to FIG. 2. Power is supplied to alarm 30 and to interlock devices typified by 10 and 20 by power supply 32. Normally closed relay contacts typified by 38, 40 and 42 are connected in series with alarm activation lines 34 and 36 of alarm 30 so that the activation of any of the interlock devices causes alarm 30 to activate. It is understood as previously mentioned that normally open relay logic, not illustrated but well known by those skilled in the art, might also be used.

Figure 3:
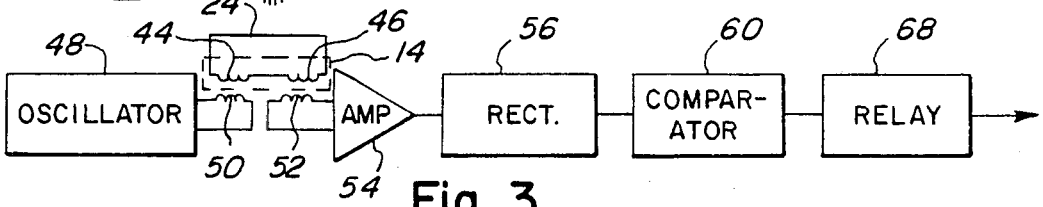
FIG. 3 is a block diagram of the circuit of one of the interlock devices per se.
Figure 4:
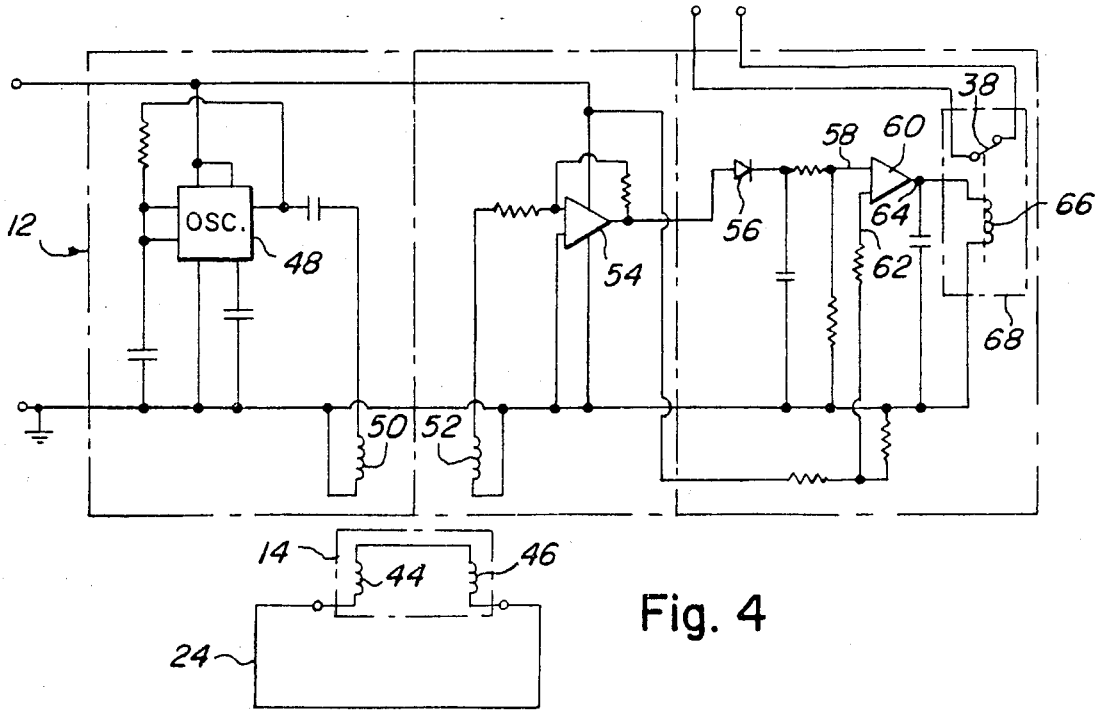
FIG. 4 is a schematic diagram of one typical interlock device.

The detailed electrical operation of the interlock devices is best understood with reference to FIGS. 3 and 4. Each secondary housing contains two secondary coils 44 and 46, which are connected in series with electrical strip 24. An oscillator 48 generates a high frequency alternating current signal which is input to primary coil 50. Since the primary coil 50 is in close magnetic proximity to the secondary coil 44 this alternating current signal is coupled to secondary coil 44 and then to secondary coil 46 via the electrical strip 24. Since secondary coil 46 is in close proximity to primary coil 52 this signal is then coupled to primary coil 52. Note that any change in the relative position of the primary coils 50 and 52 to secondary coils 44 and 46 or any break in electrical strip 24 causes a change in the amplitude of the signal induced in primary coil 52.

The signal induced in primary coil 52 is amplified by amplifier 54 and is converted to a direct current signal by rectifier 56. This signal is input to connection 58 of comparator 60 while a fixed reference signal is input at 62. The output 64 of comparator 60 is proportional to the difference of the signal levels at inputs 58 and 62 and is connected to solenoid 66 of relay 68. When the difference between the signals at the inputs of comparator 60 exceed some predetermined threshold, normally closed relay contacts 38 are switched to an open position setting off the alarm.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A contactless window tape interlock device comprising:

a. a power supply;

b. an electrically operated alarm;

c. a strip of electrically conductive material bonded to the surface of each window pane to be protected such that when any of said window panes are broken, said strip bonded to that window pane is torn, thereby interrupting the electrical conductivity of said strip;

d. two secondary coils mounted to each frame containing said window panes wherein said secondary coils are electrically connected with each other and with said strip of electrically conductive material;

e. a source of alternating electrical voltage for each of said windows;

f. a detector of alternating voltage for each of said windows, wherein said detectors are connected with said electrically operated alarm such that the activation of any of said detectors causes said alarm to activate; and g. two primary coils mounted to each window casement such that each of said primary coils is in magnetic proximity to a corresponding secondary coil wherein one of said primary coils is connected to said alternating current source and the other of said primary coils is connected to said detector such that any change in the coupling between said primary and said secondary coils or any interruption of conductivity in said conductive strip causes a change in the electrical signal inputted to said detector, thereby causing said alarm to activate.

2. A contactless window tape interlock device, as recited in claim 1, wherein said source of alternating electrical voltage for each of said windows comprises an oscillator which is connected to one of said primary coils.

3. A contactless window tape interlock device, as recited in claim 1, wherein said detector of alternating voltage for each of said windows comprises an amplifier which amplifies the output of the remaining said primary coil, a rectifier which changes the alternating current output of said amplifier into a direct current signal, a comparator which compares said direct current signal to a reference signal wherein said comparator outputs a voltage proportional to the difference between said signals, and a relay with normally closed contacts which open when said comparator output exceeds some predetermined threshold.

* * * * *